US006304520B1

(12) United States Patent
Watanabe

(10) Patent No.: US 6,304,520 B1
(45) Date of Patent: Oct. 16, 2001

(54) WRIST WATCH HAVING THERMOELECTRIC GENERATOR

(75) Inventor: Shigeru Watanabe, Iruma (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/421,243

(22) Filed: Oct. 20, 1999

(30) Foreign Application Priority Data

Oct. 22, 1998 (JP) ..... 10-300604

(51) Int. Cl.[7] ..... G04B 1/00; G24C 5/00
(52) U.S. Cl. ..... 368/203; 368/203
(58) Field of Search ..... 368/203–205

(56) References Cited

U.S. PATENT DOCUMENTS 4,106,279 * 8/1978 Martin et al. ..... 368/203

* cited by examiner

*Primary Examiner*—Bernard Roskoski
(74) *Attorney, Agent, or Firm*—Armstrong, Westerman, Hattori, McLeland & Naughton, LLP

(57) ABSTRACT

In an attempt to improve balance in size between a dial and a watch case, while securing sufficient power generated by thermoelectric elements, and also achieving miniaturization of a wrist watch having thermoelectric generator, the watch case which is closed is manufactured by fixedly attaching an insulating body to a metal case body, and securely fixing a case back made of metal to the underside of the insulating body, further, the dial, a movement, and the thermoelectric elements are housed in the watch case, and an end face of the thermoelectric elements is brought into contact with the metal case body while the other end face thereof is brought into contact with the case back. Furthermore, the metal case body is provided with a pair of thermoelectric element housings formed on the inner periphery thereof so as to be accommodated inside a pair of band mounting portions formed so as to be protruded from the outer periphery of the metal case body, so that a pair of the thermoelectric elements are housed in the pair of the thermoelectric element housings, respectively.

2 Claims, 7 Drawing Sheets

WRIST WATCH HAVING THERMOELECTRIC GENERATOR

BACKGROUND OF THE INVENTION

1. Field of the Invention

The invention relates to a wrist watch having a thermoelectric generator provided with thermoelectric elements comprising a plurality of thermocouples which are mounted in a watch case together with a movement for driving hands and serve as a power source for the movement.

2. Description of the Related Art

Each thermoelectric element is a generating element comprising a plurality of thermocouples for converting thermal energy into electric energy, which generates a voltage when there is a difference in temperature supplied to both end faces thereof. A wrist watch which comprises the thermoelectric elements is a wrist watch having a thermoelectric generator. The thermoelectric elements are mounted in a watch case together with a movement for driving the hands and this serves as a power source for the movement. The thermoelectric elements convert heat energy, caused by the difference in temperatures supplied to case back and the metal case body constituting the watch case to electric energy. And the movement is driven by this generated power (thermoelectromotive force).

The internal construction of the conventional wrist watch having a thermoelectric generator is described with reference to FIG. 10 which shows a sectional view thereof and FIG. 11 which shows a rear view thereof with the removal of the case back. FIG. 10 is a sectional view taken along the line C—C of FIG. 11.

A wrist watch having a thermoelectric generator 100 constitutes a watch case comprising an insulating body 120 fixedly attached to the lower side (underside) of the metal case body 110 with a glass plate 111 circular in a plane shape, fixedly attached thereto, a case back 130 made of metal securely fixed to the underside of the insulating body 120. The watch case houses therein a dial 40, hands (hour hand, minute hand) 51 and a movement 50 including a step motor, a gear train, a crystal oscillation circuit for driving the movement and thermoelectric elements 160.

As shown in FIGS. 10 and 11, the thermoelectric elements 160 are mounted inside the insulating body 120 but outside the dial 40 and movement 50. The thermoelectric elements 160 are housed in the watch case in a manner that they are brought into contact with the metal case body 110 at one end face and with the case back 130 at the other end face. The insulating body 120 is provided for insulating between the metal case body 110 and the case back 130 so as to easily bring about the difference in temperatures therebetween.

If a user wears the wrist watch having a thermoelectric generator 100 having such a construction on user's wrist, the case back 130 contacting the wrist is heated by the user's body temperature while the metal case body 110 opposite to the case back 130 is cooled by outside air temperature. Accordingly, the difference in temperatures between the body temperature and the air temperature is supplied to both end faces of the thermoelectric elements 160, and this difference in temperatures generates thermoelectromotive force. The movement 50 is driven by this thermoelectromotive force.

FIG. 12 is a schematic perspective view of the thermoelectric elements 160 to be mounted in this wrist watch.

Each of the thermoelectric elements 160 is of such a size to be mounted in this wrist watch having a thermoelectric generator 100 and comprise a plurality of columnar p-type thermoelectric semiconductor devices 180, a plurality of columnar n-type thermoelectric semiconductor devices 181 which are arranged regularly respecticely, and insulating resins 182 which fill between the p-type thermoelectric semiconductor devices 180 and the n-type thermoelectric semiconductor devices 181, so as to fix them integrally with one another as a whole.

In FIG. 12, respective one faces of the p-type thermoelectric semiconductor devices 180 and n-type thermoelectric semiconductor devices 181 are visible. The p-type thermoelectric semiconductor devices 180 and n-type thermoelectric semiconductor devices 181 are made of a bismuthtelluride (BiTe) alloy semiconductor.

Although not shown, electrode films are provided at both end faces of the respective p-type thermoelectric semiconductor devices 180 and the n-type thermoelectric semiconductor devices 181 for connecting mutually adjoined semiconductors with one another so as to connect these semiconductors in a series as a whole. A pair of thermocouples are constituted by the adjoined p-type thermoelectric semiconductor devices 180 and n-type thermoelectric semiconductor devices 181 which generate thermoelectromotive force respectively in accordance with the difference in temperatures. Since respective thermocouples are connected in a series with each other by the electrode films, the entire thermoelectric elements 160 generate thermoelectromotive force in accordance with the number of thermocouples contained therein.

The thermoelectric elements 160 are mounted in the wrist watch having a thermoelectric generator 100 in a manner that one of the upper and lower end faces thermally contact the metal case body 110 while the other of the upper and lower end faces thermally contact the case back 130 so as to supply a difference in temperature to each pair of thermocouples.

Meanwhile, it is known that the magnitude (power) of the thermoelectric elements 160 is determined by a gross sectional area of the p-type thermoelectric semiconductor devices 180 and n-type thermoelectric semiconductor devices 181 each constituting the thermoelectric elements 160 and the magnitude of the difference in temperatures supplied to both end faces thereof.

Suppose that each length of the p-type thermoelectric semiconductor devices 180 and n-type thermoelectric semiconductor devices 181 are about 2 mm, the difference between both temperatures produced in the wrist watch having a thermoelectric generator 100 is about 1° C. in average.

Considering the material characteristics of the BiTe thermoelectric semiconductor, and since the thermoelectromotive voltage is 200 $\mu$V/K, and the specific resistance is about $1.2\times10^{-5}$ Ωm including a wiring resistance, the maximum output per unit sectional area is 40 $\mu$W/cm$^2$.

However, this value of the output is applied to the case when all the thermoelectric elements are made up by thermoelectric semiconductors. It must be considered that the p-type semiconductor devices 180 and the n-type semiconductor devices 181 are actually filled with the insulating resins 182 which do not contribute to the generation of power. Suppose that the ratio of the areas occupied by the end faces of the p-type semiconductor devices 180, and n-type semiconductor devices 181 to the insulating resins 182 are 1:1, the areas of the p-type semiconductor devices 180 and n-type semiconductor devices 181 become merely a quarter of the entire area of the thermoelectric elements 160. Accordingly, the maximum output set forth above becomes a quarter of 40 $\mu W/cm^2$, namely, 10 $\mu W/cm^2$.

On the other hand, although the power to be consumed by the present wrist watch is about 1 $\mu W$, the power needed by the wrist watch including power for charging the wrist watch so as to drive the wrist watch even if it is not worn by a user is ten times as much as 1 $\mu W$, namely, about 10 $\mu W$.

Accordingly, the power of about 10 $\mu W$ needed by the thermoelectric elements used by the wrist watch having a thermoelectric generator 100 requires about 1 $cm^2$ as the areas of end faces of the thermoelectric elements. If the thermoelectric elements having the area of end faces of 1 $cm^2$ are mounted inside the wrist watch, the following problem occurs.

In the case of a wrist watch as shown in FIGS. 10 and 11, suppose that the thermoelectric elements have areas of about 1 $cm^2$, for example, if the thermoelectric elements each having 1 cm×1 cm in length to width are to be housed in the wrist watch, it would be very difficult in view of the available space of the wrist watch because the movement is situated at a central position.

To solve this problem, it is conceived to change the outer shapes of thermoelectric elements so as to be easily housed in a wrist watch. However, in view of the method of manufacture and construction of the thermoelectric elements, the thermoelectric elements are generally manufactured in a rectangular shape as shown in FIG. 12, it is very difficult to change the rectangular shape to a rounded shape with curved surfaces or curved lines. Even if the thermoelectric elements are manufactured in such a shape, there is a possibility that gaps would be produced between the thermoelectric elements and the watch case when they are housed in the watch case, which would cause a problem of the deterioration of filling efficiency of the thermoelectric semiconductor.

Accordingly, conventionally there has been employed a method of mounting the thermoelectric elements in a watch case, as shown in FIGS. 10 and 11, comprising steps of dividing the rectangular thermoelectric elements into several pieces so that the entire area thereof becomes 1 $cm^2$ and dispersing and disposing each piece of the thermoelectric elements around the movement 50.

In the example, as shown in FIGS. 10 and 11, the thermoelectric elements are divided into four pieces, i.e., thermoelectric elements 160, and they are respectively dispersed and disposed at four positions along the inner periphery of the metal case body 110 outside the movement 50 and dial 40.

However, since most wrist watches are substantially circular in a plane shape as shown in FIG. 11, square thermoelectric elements 160 are not fitted to be mounted in the wrist watches. If the thermoelectric elements are mounted in the wrist watch, there occurs a problem of deteriorating the utilizing efficiency of the internal space of the wrist watch, resulting in a large-sized wrist watch as a whole.

Further, when thermoelectric elements are mounted in a wrist watch having a thermoelectric generator, it is necessary to satisfy the following three mounting conditions because of the utilization of the thermoelectromotive force. That is, (1) one end face of the thermoelectric elements is directly brought into contact with a metal case body, (2) the other end face thereof is brought into contact with the case back, and (3) the metal case body and the case back are thermally insulated from each other.

Accordingly, in the case of the wrist watch having a thermoelectric generator 100 as shown in FIGS. 10 and 11, and since the thermoelectric elements 160 are brought into contact with the metal case body 110 at the other end face thereof while they are brought into contact with the case back 130 at one end face thereof, it is necessary to secure the space for housing the thermoelectric elements 160 by the metal case body 110 outside the dial 40 and dispose the insulating body 120 outside the metal case body 110.

As a result, the wrist watch having a thermoelectric generator 100 has a large area extending from the outer periphery of the dial 40 to the outer periphery of the metal case body 110 so that the entire size of the watch case including the metal case body 110 becomes large compared with the size of the dial 40. Accordingly, there occurs a problem that the balance in size between the dial and the watch case becomes worse as a whole.

As mentioned above, since the area occupied by the thermoelectric elements is determined to obtain a power needed for driving the movement by the thermoelectric elements, it is necessary to secure a space for housing the thermoelectric elements in the watch case to some larger extent. Accordingly, if the wrist watch is to be miniaturized, the dial 40 has to be miniaturized. This causes a serious problem in the manufacture of lady's small-sized wrist watches, namely, this means that lady's wrist watches having a thermoelectric generator are substantially hardly merchandised.

This is described in detail using typical numerical values. In an ordinary wrist watch, the diameter of a dial is about 25 mm. If the thermoelectric element 160 is divided into 4 as shown in FIG. 11 when it is disposed around the dial, each of the thermoelectric elements is of a size, e.g. about 8 mm×3.1 mm. Then, the circular annular portion, namely, the metal case body 110 in which the thermoelectric elements are mounted needs a width of about 5 mm. Suppose that the insulating body 120 provided around the circular annular portion has a width of about 5 mm, the diameter of the wrist watch adding these numerical values become approximately bout 45 mm which is too large even for men's wrist watches.

As one of means for solving the problem in a housing space when the thermoelectric elements are mounted in the wrist watch, it is conceived to divide the thermoelectric elements into more pieces, such as 10 or 20 pieces and the divided 10 or 20 pieces are disposed, but this is not actually practical considering the increase of a load which is produced in manufacturing or mounting the thermoelectric elements.

It is conceived, as another means for solving the problem, that a desired thermoelectromotive force is obtained even if each size of the thermoelectric elements is made small, namely, the thermoelectromotive force of the thermoelectric elements per unit volume (thermoelectromotive force density) is made large. To this end, the difference between two temperatures to be supplied to both end faces of the thermoelectric elements may be made large.

Under the circumstances, it is preferable to radiate heat from the metal case body or to absorb the body's temperature by the case back with high efficiency. Then, corresponding thereto, the difference in temperatures occurred between the case back and the metal case body becomes large, resulting in a large thermoelectromotive force density, and hence a sufficient thermoelectromotive force can be obtained even if the thermoelectric elements have small areas.

Accordingly, the size of the metal case body may be made large to enhance the heat radiation from the metal case body, which is however contrary to the miniaturization of the wrist watch, so that the miniaturization of the wrist watch having a thermoelectric generator can not be realized.

SUMMARY OF THE INVENTION

The present invention has been made to solve the forgoing problems and the invention attempts, in a wrist watch having a thermoelectric generator which mounts therein thermoelectric elements, to improve the balance in size between a dial and a watch case as a whole while securing sufficient power generated by thermoelectric elements, and also to achieve miniaturization of the wrist watch, thereby providing a wrist watch having a thermoelectric generator which is miniaturized and also excellent in design.

To achieve the above object, in a wrist watch having a thermoelectric generator and comprising a watch case which is closed by fixedly attaching an insulating body to a metal case body with a glass plate fixedly attached thereto, and securely fixing a case back made of metal to the underside of the insulating body, a dial, a movement, and thermoelectric elements serving as a power source for the movement, respectively housed in the watch case wherein an end face of the thermoelectric elements is brought into contact with the metal case body, and the other end face thereof is brought into contact with the case back, the wrist watch is constructed as follows.

That is, a pair of band mounting portions are formed so as to protrude from the outer periphery of the metal case body, and a pair of thermoelectric element housings are formed on the inner periphery thereof so as to be accommodated inside the band mounting portions, so that each of the thermoelectric elements is housed in the respective thermoelectric element housing.

Further, it is preferable that a pair of protruded portions are formed in the insulating body corresponding to the band mounting portions, and each of the protruded portions is provided with a hole section through which each of the thermoelectric elements is inserted.

Further, the case back can be divided into a first case back for sealing a movement housing region in the watch case, and a second case back made up of two pieces coming in contact with the thermoelectric elements.

The second case back made up of two pieces may be fixedly attached to the underside of the pair of the protruded portions of the insulating body. In this case, the first case back alone can be detachably attached to the insulating body.

To achieve the above object, a glass plate of the wrist watch having a thermoelectric generator according to the invention is preferably made of glass of a high heat conductivity, and it is preferably fixedly attached to the metal case body with a sealant of a high heat conductivity, interposed therebetween.

The glass plate is preferably made of sapphire glass and the sealant is composed of any or of a combination of a packing, an adhesive, and a grease, containing particles of a high heat conductivity, respectively.

Otherwise, a pair of band mounting portions may be formed so as to protrude from the outer periphery of the metal case body, and a metal band may be connected to the band mounting portions while a heat insulating band is attached to the underside of the metal band.

In this case, it is preferable that a gap is formed between the metal band and the heat insulating band.

The above and other objects, features and advantages of the invention will be apparent from the following detailed description which is to be read in conjunction with the accompanying drawings.

DETAILED DESCRIPTION OF THE PREFERRED EMBODIMENTS

The optimum embodiment of a wrist watch having a thermoelectric generator according to the invention is described now with reference to attached drawings.

Figure 1:
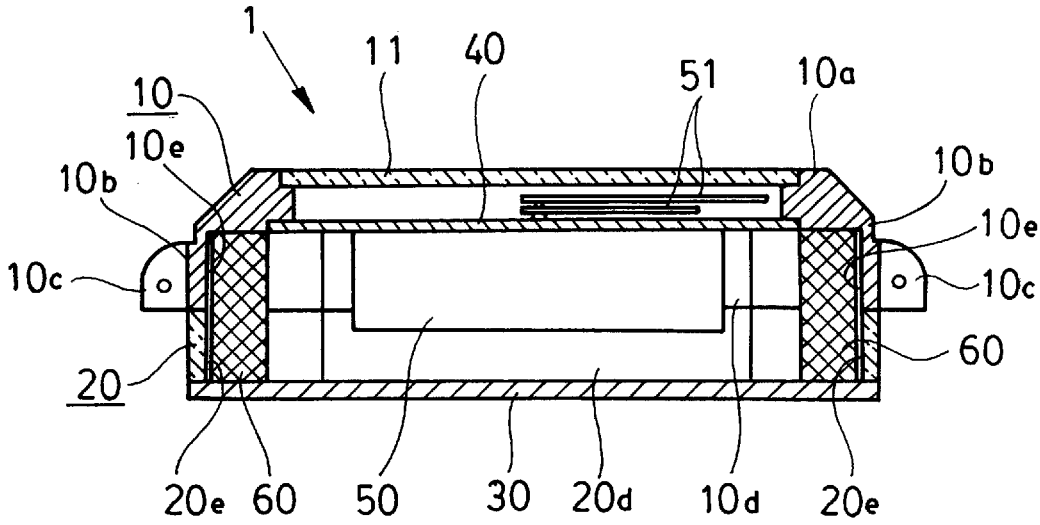
FIG. 1 is a sectional view taken along the line A—A in FIG. 2 showing the construction of a wrist watch having a thermoelectric generator according to the first embodiment of the invention.
Figure 2:
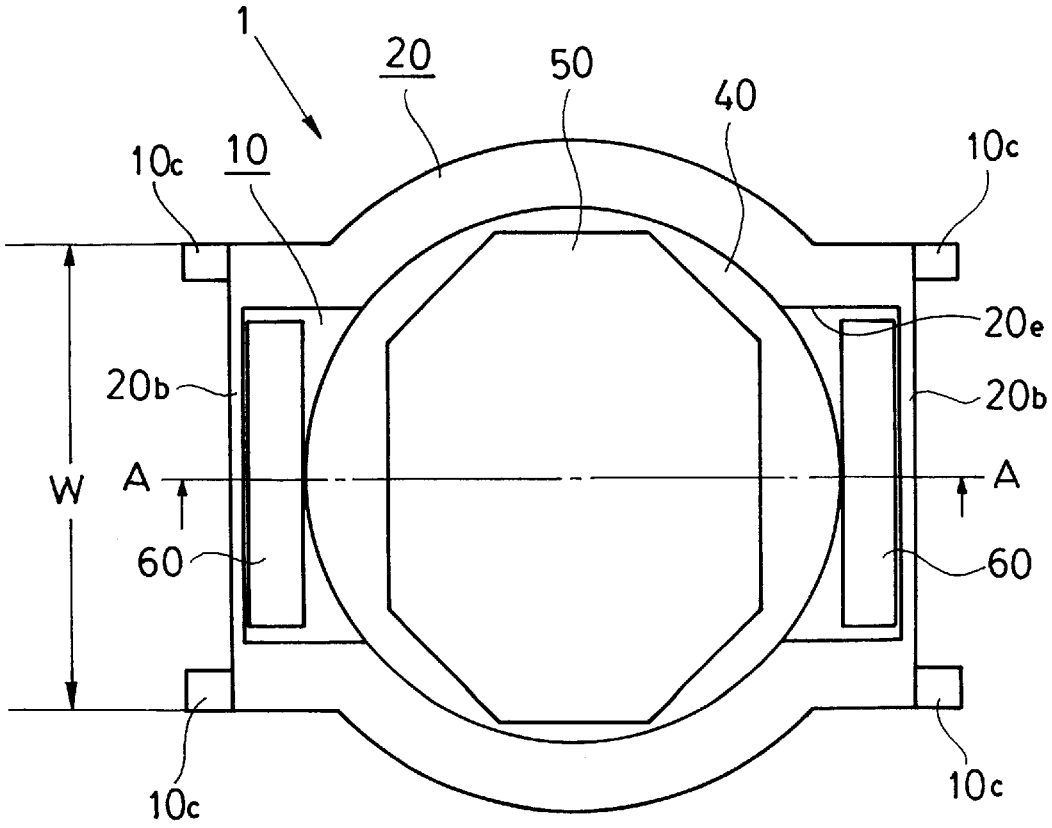
FIG. 2 is a rear view of the wrist watch having a thermoelectric generator with the case back removed.
Figure 3:
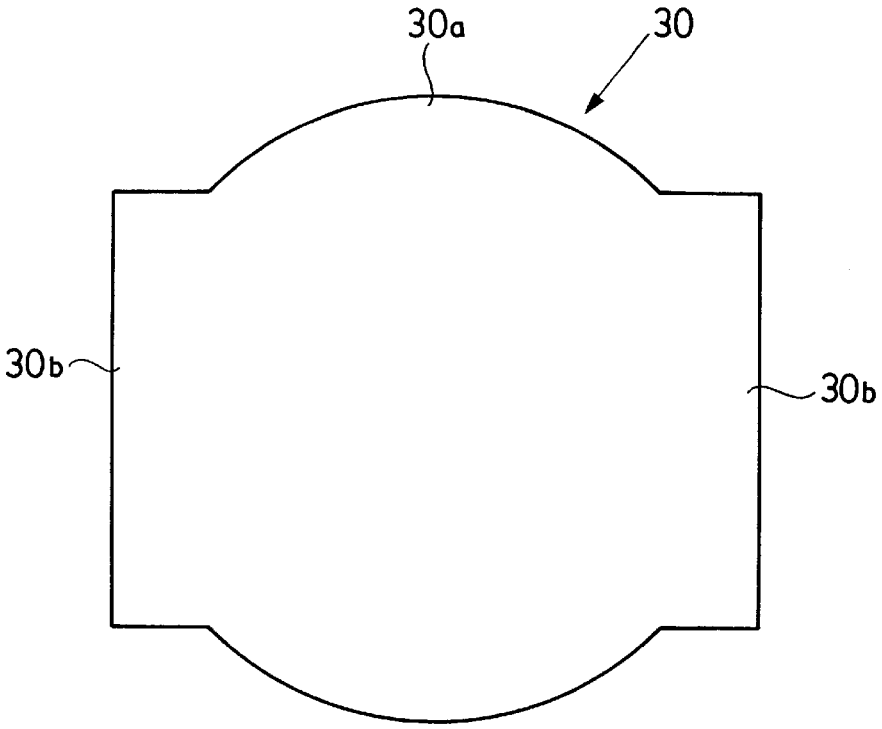
FIG. 3 is a plan view of the case back of the wrist watch having a thermoelectric generator shown in FIG. 1.

First Embodiment: FIGS. 1 to 3

First of all, the wrist watch having a thermoelectric generator according to the first embodiment of the invention is described with reference to FIGS. 1 to 3.

Figure 10:
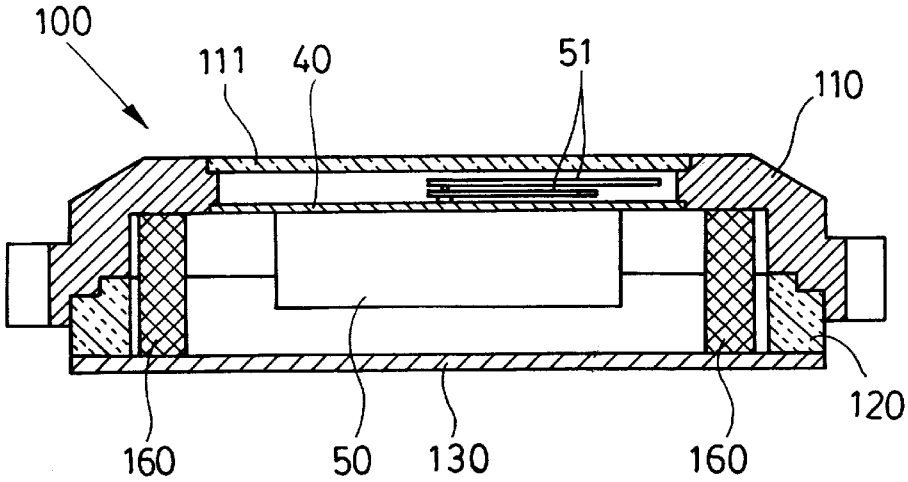
FIG. 10 PRIOR ART
FIG. 10 is a sectional view taken along the line C—C in FIG. 11 showing an example of the construction of the conventional wrist watch having a thermoelectric generator.
Figure 11:
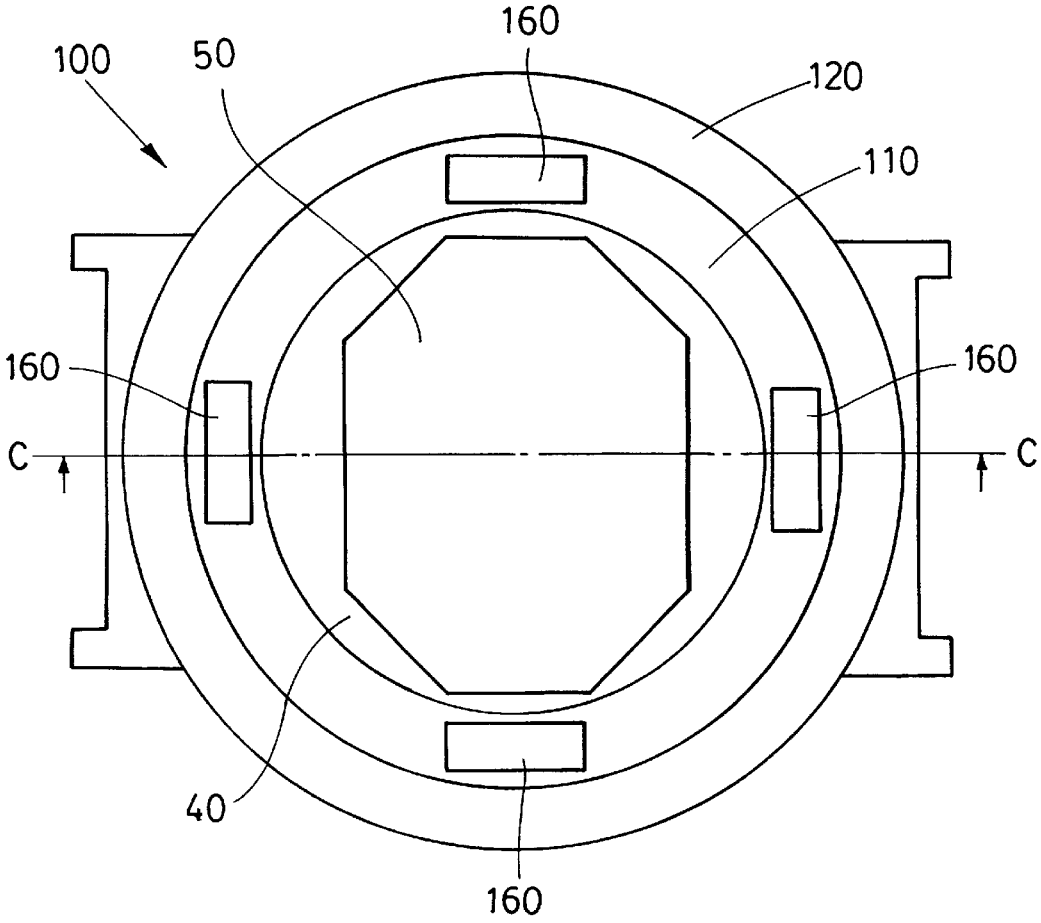
FIG. 11 PRIOR ART
FIG. 11 is a rear view of the conventional wrist watch having a thermoelectric generator with the removal of the case back thereof.

FIG. 1 is a sectional view showing the internal construction of a wrist watch having a thermoelectric generator, and it is the sectional view taken along the line A—A in FIG. 2. FIG. 2 is a rear view of the wrist watch having a thermoelectric generator with the case back removed, and FIG. 3 is a plan view of the case back alone. Components which are the same as those of the conventional wrist watch having a thermoelectric generator as shown in FIGS. 10 and 11 are denoted by the same reference numerals.

The wrist watch having a thermoelectric generator 1 comprises a watch case made up of an insulating body 20 fixedly attached to the lower side (back side ) of the metal case body 10, and a case back 30 securely fixed to the underside of the insulating body 20. A dial 40, a movement 50 including a step motor for driving hands (an hour hand and a minute hand) 51, a gear train, a crystal oscillation circuit, and the like, and thermoelectric elements 60 serving as a power source to the movement 50 are housed in the watch case.

The metal case body 10 is made of metal and is substantially cylindrical, and has a glass plate 11 which is circular in a plane shape and is fixedly attached to the metal case body 10 at the front end portion by adhesion fit therebetween. An annular potion 10*a* having an appropriate width is provided outside the glass plate 11, and a pair of band mounting portions 10*b*, 10*b* protrude from the outer periphery of the annular potion 10*a* at a position symmetrical with the annular potion 10*a* while interposing the glass plate 11 therebetween. A pair of shaft receiving portions 10*c*, 10*c* with shaft holes formed therein are provided on the band mounting portions 10*b*, 10*b* for attaching shafts to support the watch bands thereto.

The band mounting portions 10*b*, 10*b* are basically indispensable portions to the wrist watch and they are provided not only on the wrist watch having a thermoelectric generator but also on any wrist watch. The band mounting portions 10*b*, 10*b* protrude from the metal case body 10 and are substantially square even in a circular wrist watch.

Accordingly, the wrist watch having a thermoelectric generator 1 has a pair of thermoelectric element housings 10*e*, 10*e* formed on the inner periphery 10*d* of the metal case body 10 and recessed so as to be accommodated inside the band mounting portions 10*b*, 10*b*.

The insulating body 20 is provided to easily produce a difference in temperatures between the metal case body 10 and the case back 30 and is made of a high heat insulating material such as resin, and it is substantially cylindrical and has the same diameter as the metal case body 10. A pair of protruding portions 20*b*, 20*b* corresponding to the pair of band mounting portions 10*b*, 10*b* are provided on the outer periphery of the insulating body 20 and thermoelectric element housings 20*e*, 20*e* are formed on the inner periphery 20*d* thereof and recess so as to accommodate inside the protruded portions 20*b*, 20*b*.

The metal case body 10 and the insulating body 20 are securely fixed to each other while they are laid one over the other in the manner that the lower end face of the metal case body 10 is joined to the upper end face of the insulating body 20. A pair of thermoelectric element housing spaces are formed outside the inner peripheral surface of the watch case by the thermoelectric element housings 10*e* of the metal case body 10 and the thermoelectric element housings 20*e* of the insulating body 20, and a pair of thermoelectric elements 60, 60 are housed therein.

The case back 30 is formed in a shape to constitute the closed watch case corresponding to the underside of the insulating body 20 as shown in FIG. 3, and it is made of a metal plate and integrally formed of a substantially circular portion 30*a* for sealing a movement housing area of the watch case and a pair of square portions 30*b*, 30*b* formed at both sides of the substantially circular portion 30*a* for sealing the foregoing thermoelectric element housings.

The case back 30 is screwed to the insulating body 20 through screw holes (not shown) bored in given positions thereof while it is brought into intimate contact with each one end face of the insulating body 20 and the thermoelectric elements 60. The case back 30 may be fixed to the insulating body 20 by a fit construction for fitting them to each other.

Two thermoelectric elements 60 are housed and mounted in the thermoelectric element housings 10*e* so as to be accommodated inside the band mounting portions 10*b* of the metal case body 10 constituting the watch case respectively. Each of the thermoelectric elements 60 contact the upper inner surface of the thermoelectric element housings 10*e* of the metal case body 10 at the upper end face, and are housed in the thermoelectric element housings 20*e* of the insulating body 20 at the lower portion, and they also contact the inner surface of the case back 30 at the lower end face.

Figure 12:
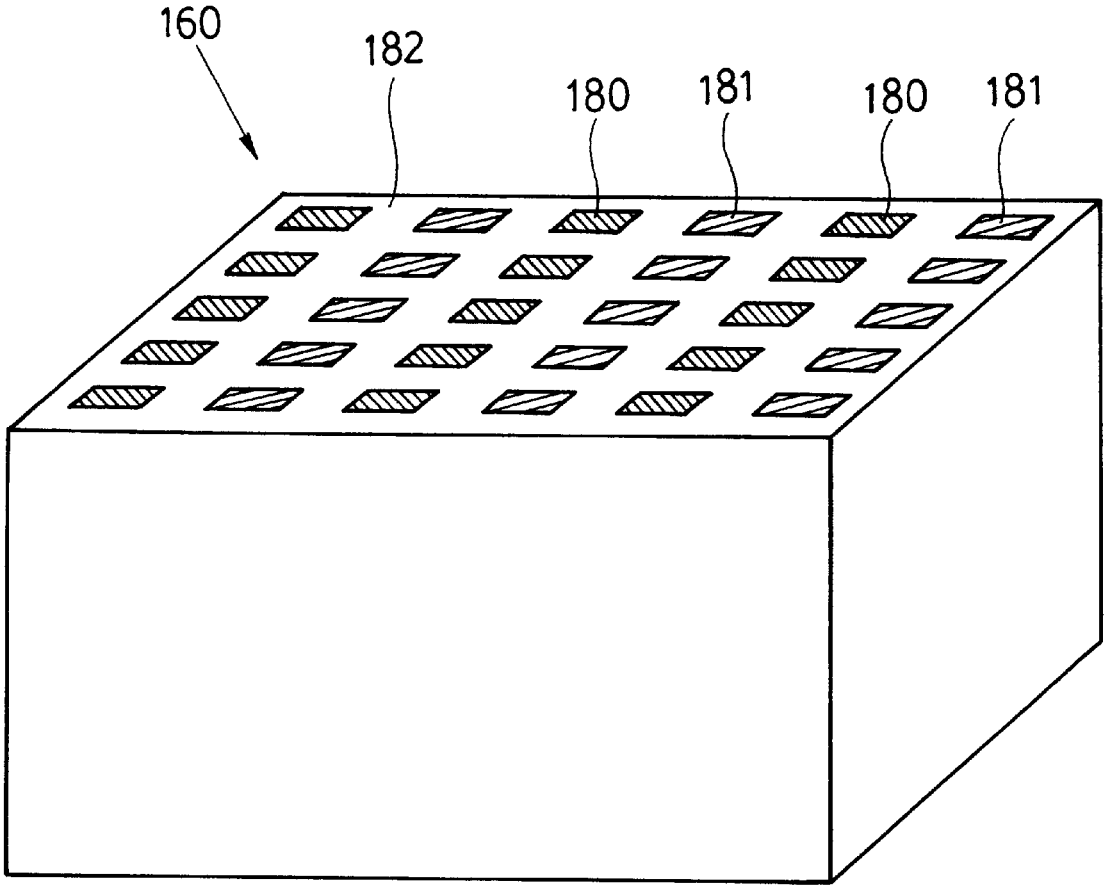
FIG. 12 PRIOR ART
FIG. 12 is a schematic perspective view of the thermoelectric elements to be mounted on the conventional wrist watch having a thermoelectric generator.

Accordingly, these two thermoelectric elements 60 are mounted in the thermoelectric element housings while satisfying all the mounting conditions. The thermoelectric elements 60 are different from the conventional thermoelectric elements 160 as shown in FIG. 12 in size but the construction of the former is the same as that of the latter, and hence the explanation thereof is omitted.

As mentioned above, when comparing the wrist watch having a thermoelectric generator 1 of the first embodiment with the conventional wrist watch having a thermoelectric generator 100 as shown in FIGS. 10 and 11, the basic construction of the former is the same as that of the latter but the construction for housing the thermoelectric elements of the former is different from that of the latter.

In the conventional wrist watch having a thermoelectric generator 100, four thermoelectric elements 160 are arranged and housed between the metal case body 110 and the movement 50 along the inner periphery of the metal case body 110, while in the wrist watch having a thermoelectric generator 1 of the first embodiment, two thermoelectric elements 60 each of which is larger than the thermoelectric element 160 are housed in the pair of thermoelectric element housings 10*e*, 10*e* formed outside the inner periphery 10*d* of the metal case body 10 so as to be accommodated inside the band mounting portions 10*b*.

Consequently, since it is not necessary to secure a space for arranging the thermoelectric elements 60 inside the inner periphery 10*d* of the metal case body 10 in the case of the wrist watch having a thermoelectric generator 1 of the first embodiment, it is not necessary to enlarge the annular potion 10*a* provided outside the glass plate 11, enhancing the utilization efficiency of the space inside the watch case.

Accordingly, the outer diameters of the metal case body 10 and insulating body 20 can be made smaller than those of the conventional metal case body 110 and insulating body 120, so that the size of the watch case is not made large as a whole than required compared with the size of the dial 40, thereby improving balance in design viewing from the entire wrist watch.

Further, as illustrated, since both the band mounting portions 10*b* of the metal case body 10 and the protruded portions 20*b* of the insulating body 20 are substantially square, the thermoelectric element housings 10*e* and thermoelectric element housings 20*e* can be shaped substantially square corresponding to the shapes of the band mounting portions 10*b* and the protruded portions 20*b* so that rectangular thermoelectric elements can be easily housed, and hence the thermoelectric elements 60 which are larger than the conventional thermoelectric elements 160 can be housed.

For example, since the width W between the band mounting portions 10*b* and the protruded portions 20*b* as shown in FIG. 2 is about 2 cm for a normal men's watch, relatively large-sized thermoelectric elements 60 can be housed. Accordingly, it is not necessary to divide the thermoelectric elements 60 into small-sized thermoelectric elements so as to house them as made in the conventional wrist watch having a thermoelectric generator.

In the wrist watch having a thermoelectric generator 1 according to the first embodiment, two thermoelectric elements 60 are mounted. However, depending on the shape of the band mounting portions of the metal case body, only one thermoelectric element 60 having an area of 1 $cm^2$, for example, 2 cm×0.5 cm in length and width, can be housed in the thermoelectric element housing formed in either of the band mounting portions.

When a user wears the wrist watch having a thermoelectric generator 1 of the first embodiment, the case back 30 contacting the user's wrist is warmed by the body's temperature while the opposite metal case body 10 is cooled by the outside air temperature. The difference in temperatures between the body's temperature and air temperature is supplied to both end faces of the thermoelectric elements 60, and a thermoelectromotive force is generated by this difference in temperatures. The movement 50 is driven by this thermoelectromotive force.

An example of the size of the wrist watch having a thermoelectric generator 1 is explained. The wrist watch having a thermoelectric generator 1 uses the dial 40 with a diameter of about 25 mm. Although the insulating body 20 and metal case body 10 are provided on the outer periphery of the dial 40, considering the fixation of the case back 30, the width in the direction of diameter necessary for the fixation of the case back 30 is about 5 mm. From the foregoing values, the diameter of the wrist watch having a thermoelectric generator 1 at the circular arc portion becomes about 35 mm which is substantially the same as an ordinary wrist watch having no thermoelectric elements.

Further, each of the thermoelectric elements 60 has the size of 16 mm×3.1 mm at the end face thereof. The width W of the band mounting portion 10*b* is 2.4 mm and the diameter of the wrist watch having a thermoelectric generator 1 passing through the center including the band mounting portions 10*b* becomes about 35.1 mm. The wrist watch having a thermoelectric generator 1 has the construction to sufficiently house two thermoelectric elements 60 therein while the size of the wrist watch keeps substantially the same as the ordinary wrist watch even if the band mounting portions 10*b* are included.

Figure 6:
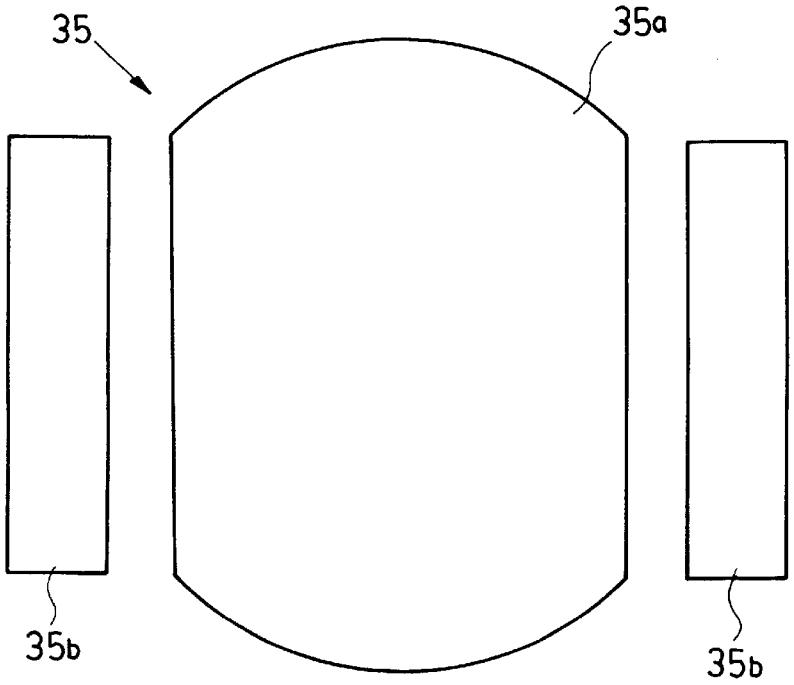
FIG. 6 is a plan view of the case back of the wrist watch having a thermoelectric generator shown in FIG. 4 wherein respective parts of the case back are separated from one another.
Figure 4:
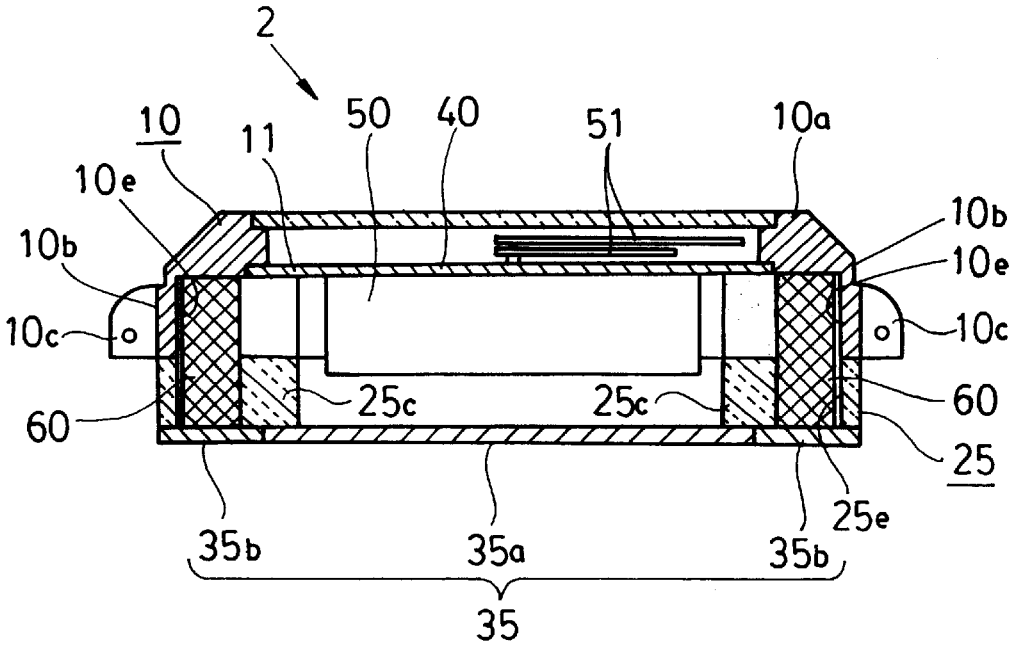
FIG. 4 is a sectional view taken along the line B—B in FIG. 5 showing the construction of a wrist watch having a thermoelectric generator according to the second embodiment of the invention.
Figure 5:
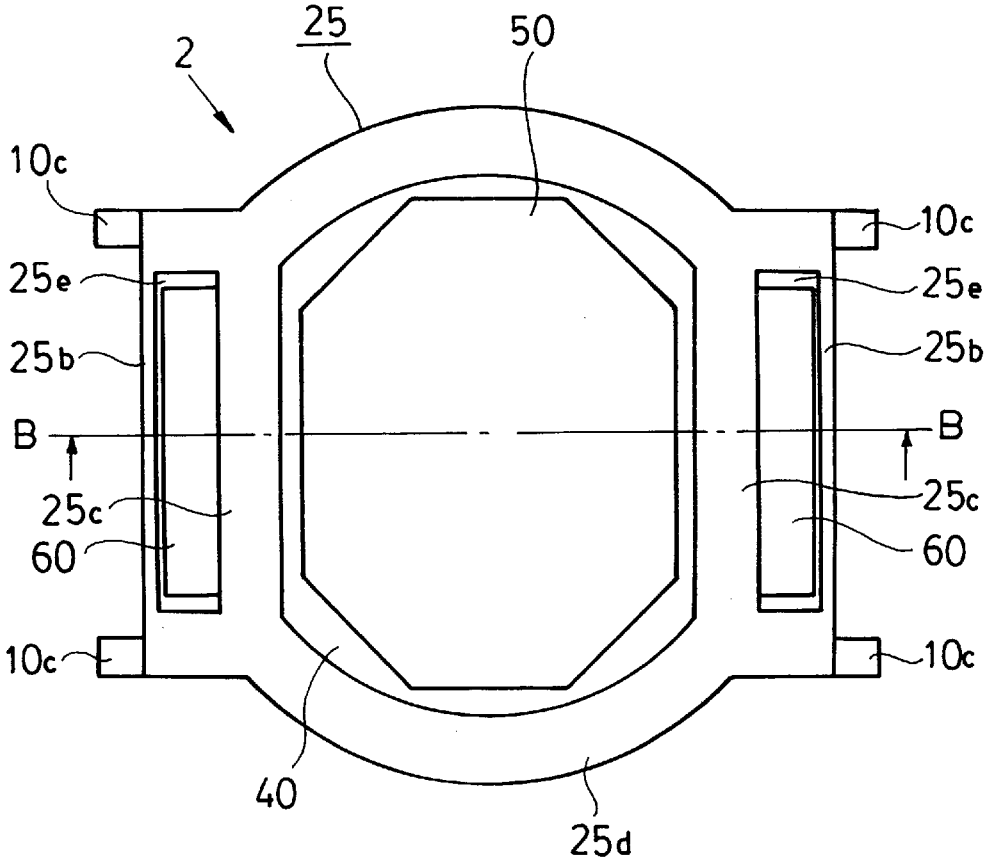
FIG. 5 is a rear view of the wrist watch having a thermoelectric generator with the case back removed.

Second Embodiment: FIGS. 4 to 6

A wrist watch having a thermoelectric generator according to the second embodiment of the invention is next described with reference to FIGS. 4 to 6.

FIG. 4 is a sectional view showing the internal construction of the wrist watch having a thermoelectric generator 1 taken along the line B—B in FIG. 5, FIG. 5 is a rear view of the wrist watch having a thermoelectric generator with the case back removed, and FIG. 6 is a plan view of the case back alone. In these FIGS., components corresponding to those of the first embodiment shown in FIGS. 1 to 3 are denoted by the same reference numerals.

Comparing a wrist watch having a thermoelectric generator 2 with the wrist watch having a thermoelectric generator 1 of the first embodiment, the components are common to those of the first embodiment except that the shapes of the insulating body 25 and the case back 35 are different from those of the insulating body 20 and the case back 30 of the first embodiment. Accordingly, the different portions are mainly explained and the explanation of the common portions are omitted or explained briefly.

The insulating body 25 has a pair of protruding portions 25*b*, 25*b* corresponding to band mounting portions 10*b* of the metal case body 10 and each of the protruded portions 25*b* has a hole section 25*e* through which each of the thermoelectric elements 60 is inserted. As shown in FIG. 5, flat shaped partition wall portions 25*c* are formed on both sides of the movement 50 parallel with each other.

The case back 35 comprises, as shown in FIG. 6, three potions, namely, a first case back 35*a* and a pair of second case backs 35*b*, 35*b*. The first case back 35*a* has an oval shape when removing the protruded portions 25*b*, 25*b* in the underside of the insulating body 25, namely, the shape capable of sealing the housing region of the movement 50 of the watch case. The second case backs 35*b*, 35*b* have rectangular shapes capable of sealing the protruded portions 25*b*, 25*b* so as to contact the thermoelectric elements 60.

The insulating body 25 and the metal case body 10 are fixedly attached to each other and the first case back 35*a* and a pair of second case backs 35*b*, 35*b* forming the case back 35 are brought into intimate contact with the underside of the insulating body 25, thereby constituting the watch case.

Thermoelectric element housings 10*e* are formed from an annular portion 10*a* of the metal case body 10 in the same manner as the first embodiment, so as to be accommodated inside the band mounting portions 10*b*.

A pair of thermoelectric elements 60, 60 are housed in the thermoelectric element housings 10*e* formed on the inner periphery 10*d* of the metal case body 10 and recess so as to be accommodated inside the band mounting portions 10*b* and they are inserted through hole sections 25*e* of the insulating body 25. The upper end face of the thermoelectric elements 60 is brought into contact with the upper inner face of the thermoelectric element housings 10*e* of the metal case body 10 while the lower end face thereof is brought into contact with the inner surface of the second case backs 35*b*.

Since a gap is formed between the partition wall portions 25*c* of the insulating body 25 and the dial 40, lead wires, etc. for connecting between the thermoelectric elements 60 and the movement 50 may be provided without any obstruction.

Further, the first case back 35*a* is detachably fixed to the underside of the circular arc portion 25*d* and the protruded portions 25*b* of the insulating body 25 by screwing, while the second case backs 35*b*, 35*b* are respectively bonded and fixed to the underside of the protruded portions 25*b* of the insulating body 25. The reason why the case back 35 is divided into three pieces wherein the first case back 35*a* is screwed and fixed and the second case backs 35*b*, 35*b* are bonded and fixed is as follows.

Since the first case back 35*a* seals the housing region of the dial 40 and the movement 50, the detachable fixation by screwing is preferable considering the maintenance thereof in a later stage.

On the other hand, since the second case backs 35*b*, 35*b* seal the housing portion of the thermoelectric elements 60, the maintenance thereof is scarcely considered but they serve to transmit user's body temperature from the outside while contacting the thermoelectric elements 60, the detachable fixation is not particularly needed. If the second case backs 35*b*, 35*b* are fixed by screwing, it is necessary to secure an additional space for forming the screw holes, resulting in the deterioration of the utilization efficiency of the space.

Further, even if the size of the wrist watch having a thermoelectric generator 2 is reduced, the sizes of the thermoelectric elements 60 are not much reduced, and hence it is necessary to reduce the widths of the 25*d* and partition wall portions 25*c* of the insulating body 25. Such reduced sizes make it difficult to fix by screwing or fitting, so that the fixation by bonding contributes to the reliable construction.

Accordingly, in the second embodiment, the case back 35 is divided into three pieces which are fixed by means corresponding to their own roles so that the utilization efficiency of the internal space is not deteriorated, thereby forming a construction for the facilitation of the maintenance thereof at a later stage. Meanwhile, the first case back 35*a* and the insulating body 25 may be fixed to each other by engagement therewith.

Meanwhile, the deterioration of the utilization efficiency of the space when fixing the case back by screwing and the facilitation of the maintenance of the movement, etc. are likewise applied to those of the wrist watch having a thermoelectric generator 1 in the first embodiment. Accordingly, the case back which is divided into three pieces like the wrist watch having a thermoelectric generator 2 of the second embodiment may be used, instead of the integrated case back 30 of the wrist watch having a thermoelectric generator 1, resulting in the prevention of the deterioration of the utilization efficiency involved in securing the screw holes, and facilitation of the maintenance at the later stage.

However, if the wrist watch having a thermoelectric generator 1 employs the case back 35 which is divided into three pieces as shown in FIG. 6, water is liable to enter from the joined portion between the first case back 35*a* and the second case backs 35*b*, and hence a waterproof function is needed. In this respect, in the case of the wrist watch having a thermoelectric generator 2 of the second embodiment, since the partition wall portions 25*c* are provided in the insulating body 25, the first case back 35*a* and the second case back 35*b* are joined with each other while they are fixedly attached to the wall portions 25*c*, thereby ensuring the watch waterproof.

Figure 7:
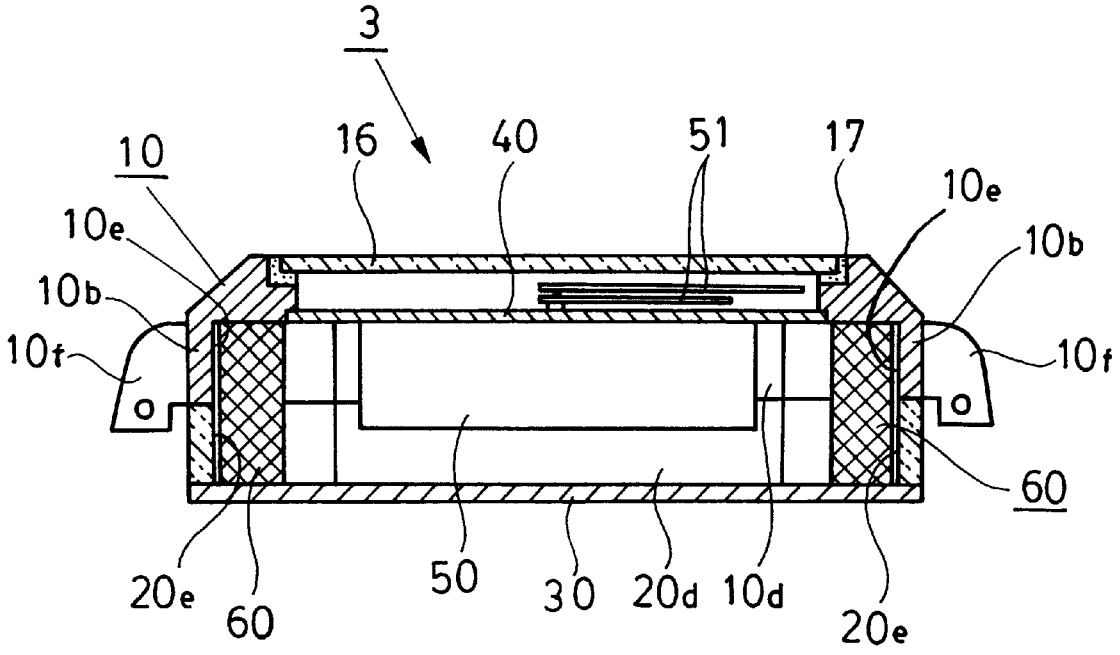
FIG. 7 is a sectional view showing the construction of the body of a wrist watch having a thermoelectric generator according to the third embodiment of the invention.
Figure 9:
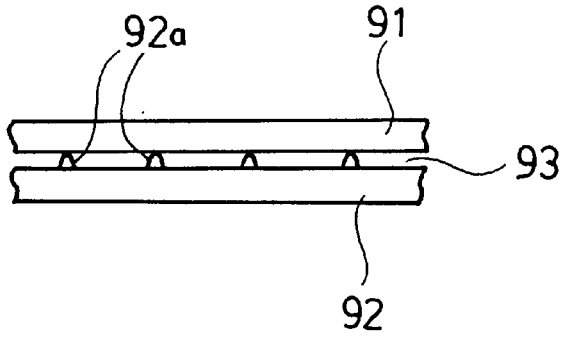
FIG. 9 is a side view of the watch band shown in FIG. 8, a part of which is enlarged.
Figure 8:
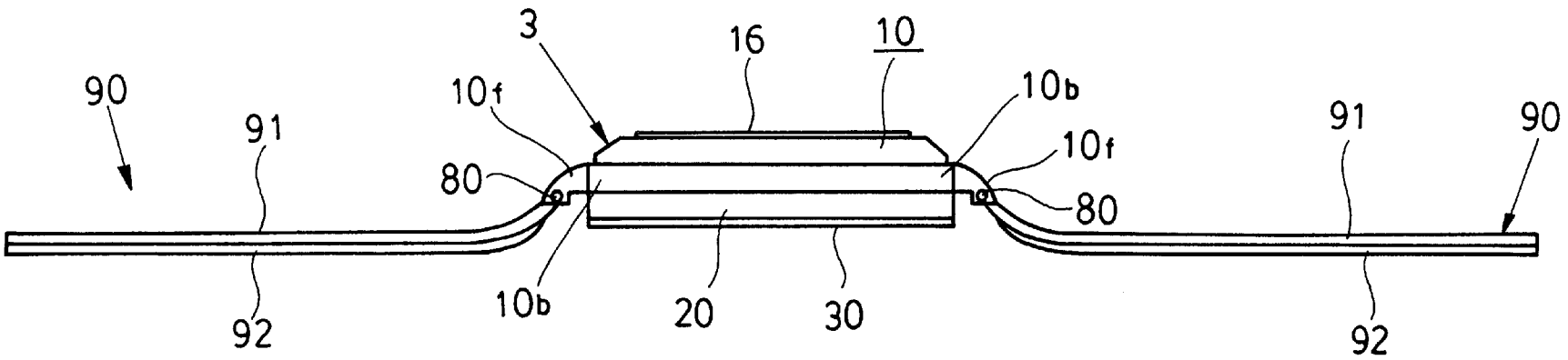
FIG. 8 is a side view showing a state where a watch band is mounted to the body of wrist watch having a thermoelectric generator shown in FIG. 7.

Third Embodiment: FIGS. 7 to 9

A wrist watch having a thermoelectric generator according to a third embodiment of the invention is next described with reference to FIGS. 7 to 9

FIG. 7 is a sectional view of a body of wrist watch having a thermoelectric generator according to the third embodiment of the invention which is similar to FIG. 1. FIG. 8 is a side view showing a state where a watch band is mounted on the wrist watch having a thermoelectric generator, and FIG. 9 is a side view of the watch band a part of which is enlarged. For the convenience of the illustration, the dimensions of a body of wrist watch having a thermoelectric generator 3 in FIG. 7 are somewhat different from those in FIG. 8, namely, the dimensional ratio between FIGS. 7 and 8 is different. The components in FIGS. 7 and 8 corresponding to those in FIG. 1 are denoted by the same reference numerals.

Although the body of wrist watch having a thermoelectric generator 3, shown in FIG. 7 has nearly the same construction as the wrist watch having a thermoelectric generator 1 of the first embodiment shown in FIGS. 1 to 3, the shape of respective shaft receiving portions 10*f* provided on band mounting portions 10*b* of a metal case body 10 is slightly different from each shape of the shaft receiving portions 10*c* shown in FIG. 1.

A glass plate 16 of the body of wrist watch having a thermoelectric generator 3 is made of glass of a high heat conductivity, and is preferably made of sapphire glass.

The glass plate 16 is fixedly attached to the metal case body 10 while interposing a sealant 17 therebetween. The sealant 17 is L-shaped in cross section and is circular annular along the peripheral edge portion of the glass plate 16 as shown in FIG. 7 wherein the sealant 17 is passed around the end surface of the peripheral edge portion of the glass plate 16 to extend to the underside thereof so that the sealant 17 is brought into intimate contact with the glass plate 16 without forming a gap. The sealant 17 employs a sealant of high heat conductivity without damaging heat transmission between the metal case body 10 and glass plate 16. For example, the sealant 17 is composed of any or a combination of a packing, an adhesive, and a grease, containing particles of a high heat conductivity, respectively.

Since the remaining construction of the body of wrist watch having a thermoelectric generator 3 is the same as that of the wrist watch having a thermoelectric generator 1 of the first embodiment shown in FIGS. 1 to 3, the explanation thereof is omitted.

With the construction of the body of wrist watch having a thermoelectric generator 3 set forth above, not only the metal case body 10 but also the glass plate 16 can be effectively utilized as heat radiation members, thereby enhancing the cooling effect of the metal case body 10 and increasing the difference in temperatures at both end faces of the thermoelectric elements 60 so that thermoelectromotive force can be increased. Accordingly, a sufficient power can be obtained even if each size of the thermoelectric elements 60 is reduced.

A watch band 90 shown in FIG. 8 comprises a pair of metal bands 91 which have high heat conductivity and heat insulating bands 92 which are connectable with each other, namely, the band is double structured. Each end of the metal bands 91 is rotatably connected to a pair of band mounting portions 10*b*, 10*b* protruded from the metal case body 10 of the body of wrist watch having a thermoelectric generator 3 by each shaft (pin) 80 which is supported by each of shaft receiving portions 10*f*.

The heat insulating bands 92 are stuck to the underside of the metal bands 91, namely, at the side which contacts the wrist of the user of the wrist watch having a thermoelectric generator. As shown in FIG. 9, it is preferable to provide a plurality of protrusions 92*a* on the heat insulating bands 92 so as to form gaps 93 between the metal bands 91 and heat insulating bands 92. As a result, the heat insulating effect between the metal bands 91 and heat insulating bands 92 can be enhanced by an air layer in the gaps 93.

In the wrist watch having a thermoelectric generator having the foregoing construction, a user can wear the wrist watch having a thermoelectric generator on the users wrist in the manner of rendering the metal bands 91 to contact the air while the heat insulating bands 92 of the watch band 90 is forced to contact the user's wrist. At this time, since the case back 30 of the body of wrist watch having a thermoelectric generator 3 contacts the wrist and the metal case body 10 contacts the air, the difference in temperatures between the body temperature and the outside air temperature is supplied to the thermoelectric elements 60 like the wrist watch having a thermoelectric generator 1 of the first embodiment, thereby generating thermoelectromotive force. The movement 50 is driven by this power.

Since the watch band 90 is double structured by the heat insulating bands 92 and metal bands 91, the following functions and effects are achieved. That is, the user's body temperature is transmitted to the case back 30, but it is not transmitted to the metal bands 91 because heat transmission is interrupted by the heat insulating bands 92, and hence the user—s body temperature is scarcely transmitted to the metal case body 10 by way of the metal bands 91.

On the contrary, since the heat of the metal case body 10 is transmitted to the metal bands 91 where the heat is radiated with a large-sized area so that the temperature of the metal case body 10 is decreased and the difference in temperatures to be supplied to the thermoelectric elements 60 can be increased.

Accordingly, the difference in temperatures at both end faces of the thermoelectric elements 60 is increased to increase the thermoelectromotive force, and hence a sufficient power can be obtained even if each size of the thermoelectric elements 60 is reduced.

In the body of wrist watch having a thermoelectric generator 3 as shown in FIG. 7, even if the glass plate 16 is made of glass of a high heat conductivity such as sapphire glass and it is merely fixedly attached to the metal case body 10 with a sealant 17 of a high heat conductivity, the thermoelectromotive force of the thermoelectric elements 60 can be increased.

Further, if the watch band 90 is double structured, namely, composed of the metal bands 91 and heat insulating bands 92, the thermoelectromotive force of the thermoelectric elements 60 can be increased.

Accordingly, if the embodiment, namely, the glass plate 16 is made of glass of a high heat conductivity and the watch band 90 is double structured, a larger thermoelectromotive force can be obtained even if the thermoelectric elements 60 have the same sizes are used. Accordingly, it is possible to reduce each size of the thermoelectric elements 60 if the wrist watch having a thermoelectric generator requires a thermoelectromotive force which is the same level as the wrist watch having a thermoelectric generator 1. If each size of the thermoelectric elements 60 is reduced, each size of the thermoelectric element housings 10*e* can be reduced so that the body of wrist watch having a thermoelectric generator 3 can be miniaturized, resulting in the improvement of balance of the entire wrist watch in a design point of view.

The metal band of the watch band 90 may be made of an integral type having a bendable lock portion while the heat insulating bands 92 may be made of an elastic material such as rubber in an annular shape. As a result, when a user wears the wrist watch having a thermoelectric generator, the heat insulating bands 92 are retained just in fit by the user's wrist and user can wear the metal bands 91 with a slight slacks over the heat insulating bands 92. Even in such a manner, it is possible to form air layers by forming gaps between the metal bands 91 and heat insulating bands 92.

Although this is exemplified in the foregoing embodiments, that the wrist watch having the glass plate and the metal case body which are substantially circular in a plain shape, they are not limited to this shape, and hence it is needless to say that the shape may be oval or square or the like in the plane shape.

As mentioned above, in the wrist watch having a thermoelectric generator according to the invention, the band mounting portions are provided on the metal case body, and the thermoelectric element housings are formed on the inner periphery thereof so as to be accommodated inside the band mounting portions. Accordingly, it is not necessary to secure the thermoelectric element housing space inside the inner periphery of the metal case body, and hence even if the size of the wrist watch having a thermoelectric generator of the invention is made the same as an ordinary wrist watch, the thermoelectric elements for obtaining necessary power can be housed. Further, the wrist watch having a thermoelectric generator is excellent in balance as a whole in a design point of view.

Since each of the thermoelectric elements to be housed in the wrist watch having a thermoelectric generator may be of a size larger than the conventional one, the number of the necessary thermoelectric elements may be small, resulting in reducing the burden involved in manufacturing and mounting thereof compared with the conventional wrist watch having a thermoelectric generator.

Further, if the case back is formed by dividing it into three pieces, namely, the first case back and a pair of second case backs, each case back can be fixed individually, so that the wrist watch having a thermoelectric generator can be miniaturized without damaging the maintenance of the movement, etc.

If the glass plate made of glass has a high heat conductivity and the sealant for fixedly attaching the glass plate to the metal case body has a high heat conductivity are used, the heat radiation from the metal case body is enhanced to render the difference in temperatures to be supplied to the thermoelectric elements large, thereby increasing the thermoelectromotive force. Even in such a construction, the thermoelectric elements can be miniaturized and the forgoing same effects can be obtained.

Still further, even if the watch band fixedly attached to the body of wrist watch having a thermoelectric generator is double structured, namely, composed of a metal band and a heat insulating band, the heat radiation from the metal case body is enhanced, and hence the foregoing same effects can be obtained.

What is claimed is:

1. A wrist watch having thermoelectric generator manufactured by a process comprising the steps of:

manufacturing a watch case which is closed by fixedly attaching an insulating body to a metal case body with a glass plate fixedly attached thereto, and securely fixing a case back made of metal to the underside of the insulating body;

housing in the watch case a dial, a movement, and thermoelectric elements serving as the power source for the movement; and bringing an end face of the thermoelectric elements into contact with the metal case body, and the other end face thereof into contact with the case back;

said metal case body being provided with a pair of band mounting portions formed so as to be protruded from the outer periphery thereof, and a pair of thermoelectric element housings formed on the inner periphery thereof so as to be accommodated inside the band mounting portions, so that each of the thermoelectric elements is housed in the respective thermoelectric element housing.

2. A wrist watch having a thermoelectric generator according to claim 1, wherein the insulating body has a pair of protruded portions corresponding to the band mounting portions, and each of the protruded portions is provided with a hole section through which each of the thermoelectric elements is inserted.

* * * * *